US005605405A

United States Patent [19]

Kurz

[11] Patent Number: 5,605,405

[45] Date of Patent: Feb. 25, 1997

[54] INK RIBBON FOR A PRINTER, TYPEWRITER OR THE LIKE

[75] Inventor: Herbert Kurz, Fuerth, Germany

[73] Assignee: Leonhard Kurz GmbH & Co., Furth, Germany

[21] Appl. No.: 306,815

[22] Filed: Sep. 15, 1994

[30] Foreign Application Priority Data

Oct. 4, 1993 [DE] Germany ..... 43 33 740.6

[51] Int. Cl.[6] ..... B41J 33/02

[52] U.S. Cl. ..... 400/239; 400/249

[58] Field of Search ..... 400/239, 238, 400/249, 237, 225, 711

[56] References Cited

U.S. PATENT DOCUMENTS

| | | | |
|---|---|---|---|
| 2,020,152 | 11/1935 | Mannino | 400/238 |
| 2,793,153 | 5/1957 | Grundel | 400/194 |
| 4,863,297 | 9/1989 | Fujii | 400/249 |
| 5,110,229 | 5/1992 | Ide | 400/239 |

FOREIGN PATENT DOCUMENTS

| | | | |
|---|---|---|---|
| 375185 | 3/1991 | European Pat. Off. . | |
| 0290079 | 12/1986 | Japan | 400/239 |
| 4363281 | 12/1992 | Japan | 400/196.1 |

*Primary Examiner*—Edgar S. Burr
*Assistant Examiner*—Anthony H. Nguyen
*Attorney, Agent, or Firm*—Louis E. Marn

[57] ABSTRACT

An ink ribbon for a printer or the like has a leading and/or trailing, optically operative control strip. The control strip has only a first light-impervious or opaque control portion and a second transparent control portion. The control portion adjoining the ink ribbon is of a length of between 1 and 4 cm.

7 Claims, 1 Drawing Sheet

FIG. 1
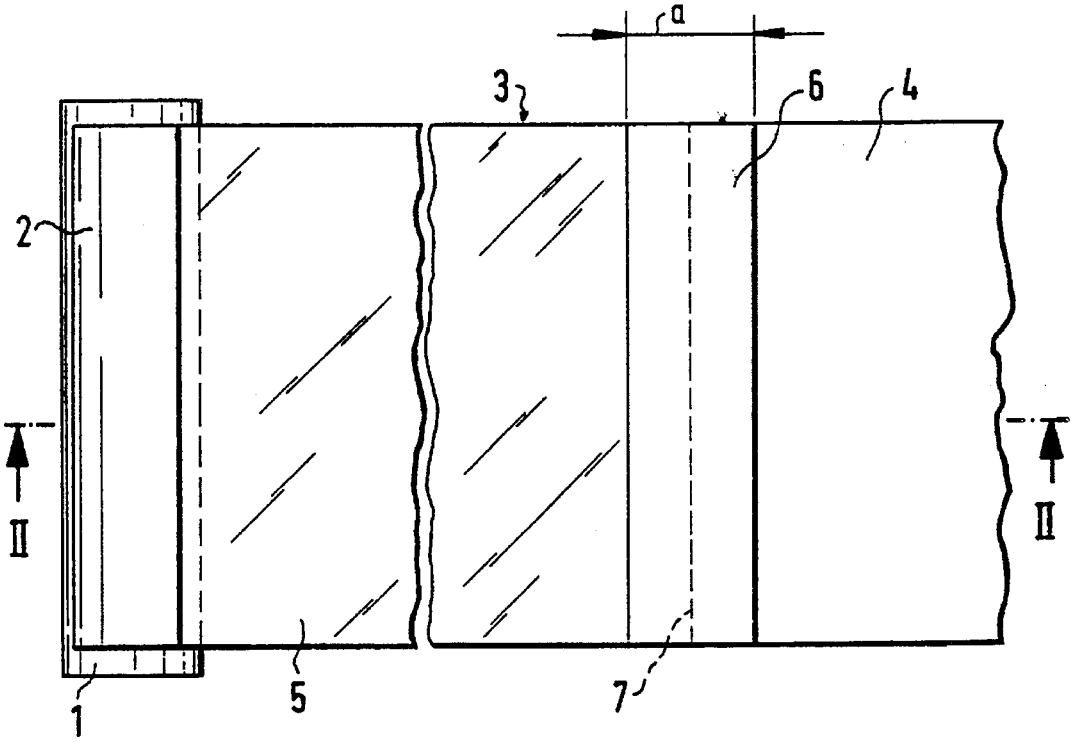
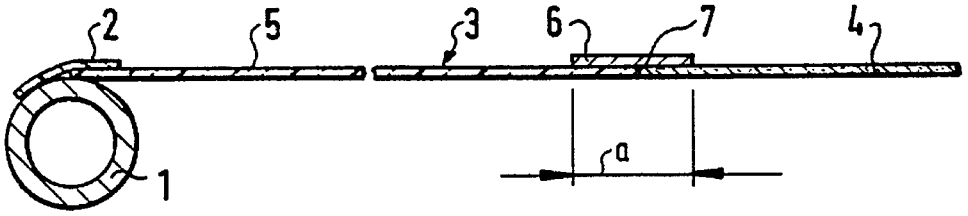
FIG. 2

INK RIBBON FOR A PRINTER, TYPEWRITER OR THE LIKE

BACKGROUND OF THE INVENTION

The invention concerns an ink ribbon for a printer, typewriter or the like, more particularly but not exclusively a transfer ribbon for a thermal transfer printer.

An ink ribbon for a printer or the like is often provided with a sensing or control strip, referred to hereinafter as the control strip, which is adapted to produce an optical effect. The control strip may be disposed at the leading end or the trailing end or at both ends of the ribbon. The optically operative control strip, in conjunction with a suitable sensor arrangement in the printer, provides that, when the end of the ink ribbon is reached, the ink ribbon stops and further operation of the printer is disabled. Hitherto, various kinds of control strips have been used, more particularly in dependence on the nature of the layer of ink on the ink ribbon. If a transparent control strip is used, light can suddenly pass through the control strip at the end of the ink ribbon when the control strip reaches the sensor arrangement of the printer, and as a result the procedure for switching off the printer is triggered. It is however also possible to use a light-impervious control strip so that, when the control strip passes into the region of the corresponding sensor arrangement, less light is allowed to pass through the control strip, in comparison with the ink ribbon. That reduction in the degree of transmission of light then represents the signal for the printer to be switched off. Now, hitherto the situation was such that different control strips have been used in dependence on the different types of printers for which the ink ribbons are intended, more specifically, either control strips which have a higher degree of light-transmissivity or transparency relative to the ink ribbon, or control strips whose light-transmissivity or transparency is less than that of the ink ribbon. That involves an increased level of expenditure, both in regard to the manufacturer of the ink ribbons and also in regard to the dealers trading with such articles. Moreover, if a user inadvertently employs an ink ribbon with an unsuitable control strip, which is possible in view of the fact that the ink ribbons or the cartridges thereof are otherwise of the same configuration, that can even give rise to serious damage to the printer.

JP-A-3(1991)-75185 discloses a thermal transfer ribbon in which the control strips are longitudinally divided. Control strip portions having a multiplicity of alternately transparent and opaque regions are provided at one end above the line of division of the control strip and at the other end below that line of division. That makes it possible to distinguish between the leading end and the trailing end of the ink ribbon. However, such a ribbon can also only be used with certain types of printer.

SUMMARY OF THE INVENTION

An object of the present invention is to provide an ink ribbon for a printer or the like, having at least one control strip of a specific configuration such as to be suitable both for areas of use in which a control procedure is triggered at the respective end of the ink ribbon by an increased level of light-transmissivity or transparency, and also for those areas of use where the control procedure is produced by a reduced level of light-transmissivity, thereby to reduce storage and production expenditure on the part of manufacturers of such ribbons, to achieve a reduction in the number of types of ribbon required from the point of view of dealers and to ensure that damage to a printer or the like by virtue of using an ink ribbon with the wrong control strip can be at least alleviated.

Another object of the present invention is to provide an ink ribbon for a printer, typewriter or the like, which enjoys enhanced versatility of use with all its attendant advantages.

Still another object of the present invention is to provide an ink ribbon for a printer, typewriter or the like machine, having at least one control strip at a respective end thereof adapted to provide for reliable control of the machine in which the ribbon is used.

In accordance with the present invention the foregoing and other objects are achieved by an ink ribbon for a printer, typewriter or the like machine, for example a transfer ribbon for a thermal transfer printer, having an optically operative control strip at the leading end and/or the trailing end of the ink ribbon. The control strip has only a first, substantially light-impervious or opaque control portion and a second transparent control portion. The length of the control portion which adjoins the ink ribbon, as measured in the direction of feed of the ink ribbon, is between about 1 and 4 cm. A preferred length is about 2.5 cm.

In accordance with the invention therefore the difficulties encountered in prior ribbons as discussed above can be overcome in a very simple manner by virtue of the inclusion of a control strip which is adapted to cause a response on the part of both control devices which react to an increased level of light-transmissivity or transparency, and also those control devices which respond to a reduced level of light-transmissivity or transparency. The invention thus makes use of the fact that the ink ribbon is not normally used as far as the absolute end thereof, but rather the corresponding control sensors are so arranged in a printer that, between the region of the control strip which is responsible for triggering off the sensor control operation and the end of the ink surface of the ink ribbon, there is still a distance which is at any event sufficient to trigger off a control procedure in the printer. For that reason, in the ink ribbon according to the invention, the first and second control portions of the control strip can be easily arranged in succession in the longitudinal direction of the control strip. It is sufficient if there is only one portion of the two kinds of control strip, namely transparent on the one hand and light-impervious or opaque on the other hand. It is usually also sufficient if a control strip is provided only at the trailing end of the ink ribbon. However, it is also possible to envisage situations of use, for example when the ink ribbon can be used repeatedly, where it is desirable to provide a control strip at each of the two ends of the ink ribbon. In that case, the control portions of the two control strips are usually arranged in mirror-image relationship with each other. Because of the length of the first control portion, as measured in the direction of feed of the ink ribbon, of between about 1 and 4 cm, preferably about 2.5 cm, an ink ribbon in accordance with the invention can be used in most printers or like machines which are available on the market at the present time. If the control portions which lead in the ink ribbon feed direction are of the above-indicated length, that reliably ensures that the printer or like machine is switched off when the respective control portion reaches the sensor arrangement of the machine, even when the ink ribbon is moving quickly. It will be appreciated that the length of the control portions depends on the speed of feed movement of the ink ribbon and the geometry of the sensor arrangement used. In this respect, tests have shown that a control portion length of 2.5 cm is adequate to ensure that the printer or like machine is reliably switched off, while on the other hand the amount of ink ribbon that remains unused at the end is not excessive.

In accordance with a preferred feature of the invention the light-impervious or opaque control portion or portions can be formed by a metallized foil as then a considerable reduction in the level of light-transmissivity can be achieved with a comparatively small layer thickness. At the same time the reflecting properties of the metallized foil can be optionally employed to trigger off control procedures by virtue of a response to the variation in reflection of the control portion.

In accordance with another preferred feature of the invention, in order to control the printer or like machine as quickly as possible when the end of the ink ribbon is reached, it is desirable for the first light-impervious or opaque control portion of the control strip to be arranged immediately adjoining the ink ribbon.

In that respect, in accordance with another advantageous feature, the transparent control portion of the control strip may be connected to the ink ribbon by means of the first light-impervious or opaque control portion. That configuration affords the advantage that the optical aspect of the transparent control portion is not disturbed. On the other hand the opaque or light-impervious control portion or portions is or are sufficiently wide that, if the ink ribbon on the one hand and the transparent control portion on the other hand are arranged in such a way that they meet each other, the available area for making the adhesive connection between the ink ribbon and the control portions is sufficiently large to withstand the tensile forces which are applied to the ribbon.

Further objects, features and advantages of the invention will be apparent from the following description of a preferred embodiment.

BRIEF DESCRIPTION OF THE DRAWING

FIG. 1 is a plan view of a control strip at the end of an ink ribbon in the form of a thermal transfer ribbon, and FIG. 2 is a view in section taken along line II—II in FIG. 1.

DESCRIPTION OF THE PREFERRED EMBODIMENT

Looking at the drawing, an ink ribbon for a printer, typewriter or the like, for example a thermal transfer ribbon for a thermal transfer printer, includes a spool 1 to which the end of a control strip generally identified by reference numeral 3 is suitably fixed as by means of an adhesive strip 2. At the end remote from the spool 1 the control strip 3 is connected to the ink ribbon which is generally identified by reference numeral 4.

It will be seen from the drawing that, in the illustrated embodiment, the control strip 3 comprises a transparent control strip portion 5 and a light-impervious or opaque control portion 6. The control portion 6 may be of a suitable degree of light-imperviousness, right up to the extent of being totally opaque. In the illustrated embodiment the transparent control strip portion 5 is of comparatively great length. It is generally sufficiently long to bridge over the distance between the mounting for the spool 1, and the region of the printer or like machine where the ink ribbon 4 is acted upon for printing purposes.

The control portion 6 is preferably a strip of a metallized foil. The presence of the metallized surface can also be used to cause control procedures to be triggered off by a variation in the reflection at the surface or the properties of an electrical circuit.

As can be seen more particularly from FIG. 2, the control portion 6 in the illustrated embodiment serves at the same time to connect the individual control portions 5 and 6 to each other and to the ink ribbon 4. That is easily achieved by the transparent foil 5 and the ink ribbon 4 bearing against each other along the line indicated at 7, in the region of the control portion 6. Both the end of the ink ribbon 4 and also the end of the transparent control portion 5 are suitably fixed by adhesive to the underside of the control portion 6.

The configuration of the illustrated embodiment has the advantage that the transparent control portion 5 and the ink ribbon 4 blend into each other without any step or interruption, at least on one side of the strip, which has an advantageous effect in terms of feed transportation of the ribbon. It will be appreciated that it would also be possible, in certain situations of use, to provide a certain spacing between the end of the transparent control portion 5 and the end of the ink ribbon 4.

In order to guarantee proper functioning of the control strip 3 in the ink ribbon according to the invention, the length of the individual control portions must be sufficiently great. In the illustrated embodiment it will be seen that the transparent control portion 5 is relatively long. In contrast, the light-impervious or opaque control portion 6 must be of a minimum possible length a in the direction of movement of the ink ribbon, in order to ensure that the length of ink ribbon 4 which remains unused at the end thereof is as short as possible, even in the case of those printers or like machines in which the control members respond to the increased level of transparency, that is to say the transparent control portion 5. Desirably therefore the length as indicated at a of the control portion 6 is only between 1 and 4 cm. In most cases it is sufficient if the length a of the control portion 6 is about 2.5 cm.

The drawing illustrates a comparatively wide ink ribbon, but it will be appreciated that the principle of the invention can also be used in the case of narrower ribbons or ribbons of a different kind. The nature of the actual ink ribbon 4 is also not a matter of material significance in this respect.

The control strip which is optically operative to control operation of the printer, typewriter or the like machine in which the ribbon is used may be disposed at the leading end of the ribbon or the trailing end of the ribbon or at both ends of the ribbon. It will be seen moreover that the control portions 5 and 6 extend over the entire width of the control strip 3 in this embodiment.

It will be appreciated that the above-described configuration of the invention has been set forth solely by way of example and illustration of the principles thereof and that further modifications and alterations may be made therein without thereby departing from the spirit and scope of the present invention.

What is claimed is:

1. An ink ribbon having a spool for a printer, typewriter or the like, which comprises an optically operative control strip attached to said spool at a trailing end of said ink ribbon, said optically operative control strip, respectively, having only a first light-impervious control portion and only a second transparent control portion, said first light-impervious control portion adjoining said ink ribbon, the length of said first light-impervious control portion adjoining said ink ribbon as measured in a direction of feed of said ink ribbon being from about 1 to 4 cm.

2. The ink ribbon as set forth in claim 1 wherein said first light-impervious control portion is a metallized foil.

3. The ink ribbon as set forth in claim 1 wherein said second transparent position of said control strip is connected to said ink ribbon by said first light-impervious control portion.

4. The ink ribbon as set forth in claim 1 wherein said first light-impervious control portion is of a length of about 2.5 cm.

5. The ink ribbon as set forth in claim 1 wherein said control portions extend over substantially the entire width of said control strip.

6. A ribbon for a printer, typewriter or the like, which comprises an elongated ribbon portion operable to produce printing and having first and second ends, and a control strip connected to one end of said ribbon portion and adapted to produce an optical control effect, said control strip comprises only a first substantially light-impervious control portion and only a second substantially transparent control portion, said first and second control portions being disposed in succession in a direction of elongation of said ribbon, said first light-impervious control portion adjoining said ribbon portion, the length of said control portion adjoining said ribbon portion as measured in a direction of feed of said ribbon being from about 1 to 4 cm.

7. The ink ribbon as set forth in claim 6 wherein an end of said ribbon portion adjoins an edge of said second transparent control portion and wherein said first light-impervious control portion overlies said end of said ribbon portion and said second transparent control portion.

* * * * *